US011746510B2

(12) United States Patent
Neilson et al.

(10) Patent No.: US 11,746,510 B2
(45) Date of Patent: Sep. 5, 2023

(54) FIRE HYDRANT SYSTEM

(71) Applicants: Myron Ben Neilson, Hatch, UT (US); Lantz Neilson, Grantsville, UT (US)

(72) Inventors: Myron Ben Neilson, Hatch, UT (US); Lantz Neilson, Grantsville, UT (US)

( * ) Notice: Subject to any disclaimer, the term of this patent is extended or adjusted under 35 U.S.C. 154(b) by 0 days.

(21) Appl. No.: 17/743,065

(22) Filed: May 12, 2022

(65) Prior Publication Data

US 2022/0372736 A1 Nov. 24, 2022

Related U.S. Application Data

(60) Provisional application No. 63/189,848, filed on May 18, 2021.

(51) Int. Cl.
*E03B 9/14* (2006.01)
*E03B 9/04* (2006.01)

(52) U.S. Cl.
CPC . *E03B 9/14* (2013.01); *E03B 9/04* (2013.01)

(58) Field of Classification Search
CPC ..... E03B 9/14; E03B 9/04
See application file for complete search history.

(56) References Cited

U.S. PATENT DOCUMENTS 426,457 A * 4/1890 Lingemann ..... E03B 9/14 137/282
820,940 A * 5/1906 Stoddard ..... E03B 9/04 137/299
1,270,677 A * 6/1918 Yassukovich ..... E03B 9/04 137/308
5,218,987 A * 6/1993 Heil ..... E03B 9/04 137/15.02
5,769,112 A * 6/1998 Rendina ..... E03B 9/04 248/68.1
2006/0070657 A1* 4/2006 Kang ..... E03B 9/14 137/294
2011/0186145 A1* 8/2011 Cantrell ..... E03B 9/08 137/281

* cited by examiner

*Primary Examiner* — Kevin R Barss
(74) *Attorney, Agent, or Firm* — GURR BRANDE & SPENDLOVE, PLLC; Robert A. Gurr

(57) ABSTRACT

A fire hydrant system includes a fire hydrant (upper barrel and bonnet) that is separate from a first cover tube and a second cover tube that house a valve stem. To activate the system, a user opens a gate valve via the valve stem, thereby allowing water to enter the upper barrel of the fire hydrant. When the gate valve is closed, a drain valve allows water to exit the upper barrel, lower barrel, and shoe fitting, preventing damage during freezing temperatures.

14 Claims, 12 Drawing Sheets

FIRE HYDRANT SYSTEM

CROSS-REFERENCE TO RELATED APPLICATIONS

This application claims priority to U.S. Provisional Application Ser. No. 63/189,848, filed May 18, 2021, which is incorporated herein by reference.

TECHNICAL FIELD

The present disclosure relates to a fire hydrant system. More particularly, the present disclosure relates to an open-close valve stem separated from the bonnet and upper barrel of the fire hydrant.

BACKGROUND

Fire hydrants may be found in numerous places around the world and have been used for hundreds of years. Fire hydrants allow fire fighters to directly access water supplies to extinguish fires. Modern day fire hydrants include an upper barrel, outlet, and an operating nut connected to an operating stem and valve. To use these hydrants, a fire fighter couples a hose to the outlet and opens the valve via the operating nut, which allows water from the water supply to enter the hose. Additionally, fire hydrant types may vary depending on the climate where they are located. In cooler temperatures, where it freezes, the fire hydrants will be "dry barrel" hydrants. These dry barrel hydrants have a valve at the bottom of the barrel, allowing the barrel to be empty during non-use. Dry barrels also have drain valves to remove any remaining water in the barrel after the valve is sealed. In warmer climates, fire hydrants may be "wet barrel" hydrants, which have water in the barrel at all times.

Even with distinct fire hydrants for different climates, the fire hydrants on the market have many short comings that have not been addressed. For example, maintaining and updating components, such as the drain valves, on fire hydrants may be troublesome due to the operating stem and valve being located in the barrel. When a drain valve needs to be replaced, a user must work around or remove the operating nut and stem to access the drain valve, which may be extremely difficult and time-consuming.

Accordingly, there is a need for a fire hydrant system that is resistant to any type of weather and easy to maintain. The present disclosure seeks to solve these and other problems.

SUMMARY OF EXAMPLE EMBODIMENTS

In some embodiments, a fire hydrant system comprises a first cover tube and a second cover tube. The first cover tube comprises a first flange and the second cover tube comprises a second flange. The first and second flanges may be coupled together via cover tube bolts (e.g., break away bolts). The second cover tube may couple to a gate valve while the first cover tube may extend upwardly from ground level. Positioned inside the first cover tube may be a first valve stem, which may comprise a valve stem nut (e.g., a five-sided nut) on a top end. In some embodiments, a cap cover may be positioned on the first cover tube, covering the valve stem nut. At a bottom end of the first cover tube, a top end of a second valve stem may couple thereto via a fastener (e.g., a breakaway stem coupling). Additionally, a bottom end of the second valve stem may comprise a stem key adapter that interacts with a valve nut on the gate valve. When a user couples a wrench to the valve stem nut and loosens it, the stem key adapter opens the gate valve, allowing water to enter the system.

The gate valve may couple to a shoe fitting, which may comprise a first drain valve, such as an auto drain valve. The shoe fitting may be an L-shaped fitting that couples to a lower barrel via bolts. The lower barrel may comprise a second drain valve, such as a side mounted auto drain valve, although not required. The fire hydrant system may comprise a first drain valve and/or a second drain valve. The lower barrel may be positioned underground and extend vertically and couple to an upper barrel via bolts. The upper barrel is positioned above ground and may comprise one or more water outlets. The upper barrel may be coupled to a bonnet via bolts. The bonnet may comprise an eye bolt that allows a user to lift and maneuver the hydrant barrel and bonnet (collectively referred to as the "fire hydrant"). In some embodiments, a first support may extend between the first cover tube and the fire hydrant, coupling to the bolts on the fire hydrant and the cover tube bolts. Additionally, a second support may extend between the second cover tube and the lower barrel. It will be appreciated that the first and second supports stabilize and add rigidity to the fire hydrant system.

BRIEF DESCRIPTION OF THE DRAWINGS

FIG. 15AB illustrates a retrofitted fire hydrant of the prior art to be a fire hydrant system.

DETAILED DESCRIPTION OF EXAMPLE EMBODIMENTS

Figure 1:
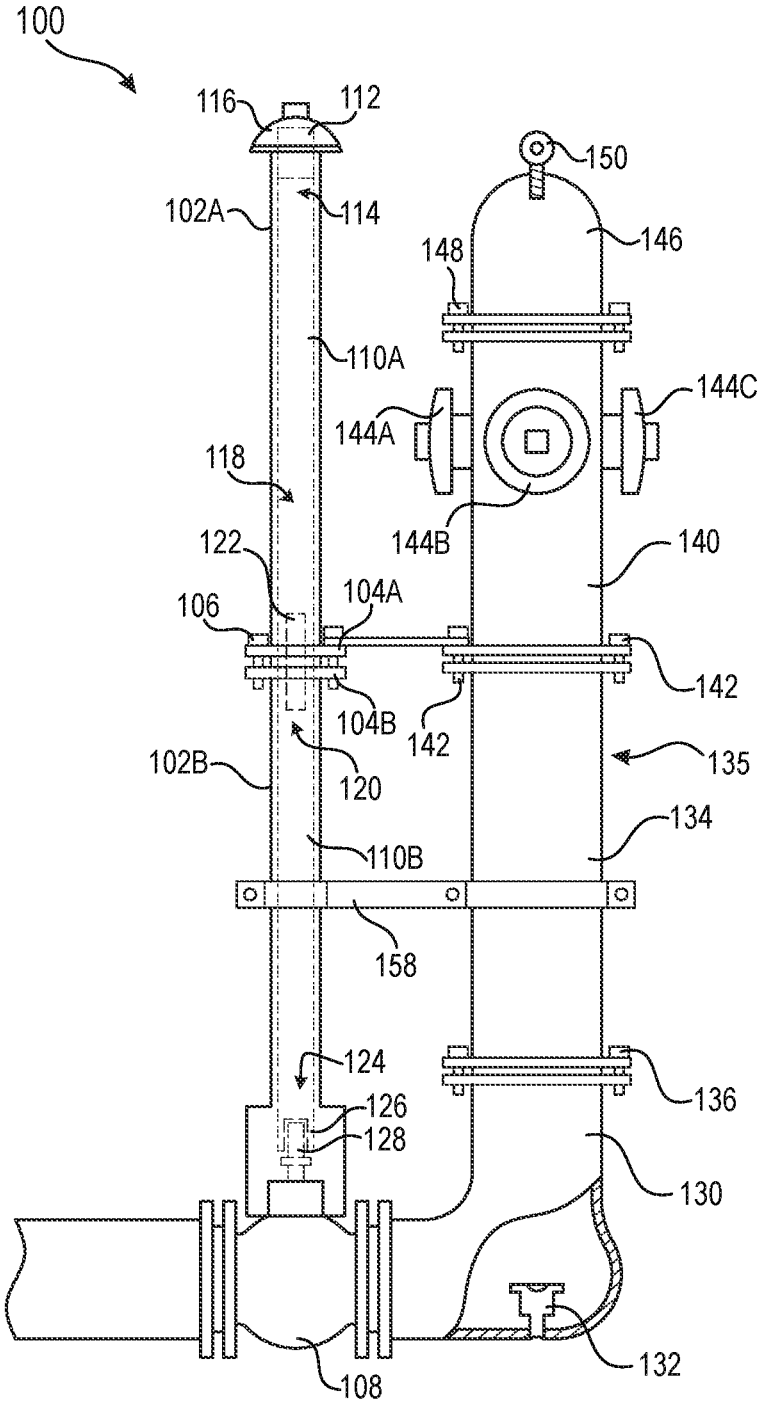
FIG. 1 illustrates a side elevation view of a fire hydrant system.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As discussed earlier, there is a need for a fire hydrant system that is resistant to any type of weather and easy to maintain. The present disclosure seeks to solve these and other problems.

Generally, the fire hydrant system described herein comprises a first and a second cover tube coupled to a gate valve. The first and second cover tubes comprise a valve stem therein that can open or close the gate valve via a valve stem nut. A drain valve allows water to be removed from an upper and lower barrel, thereby allowing the fire hydrant to drain after use and be protected from freezing temperature. It will be appreciated that the gate valve and valve stem are separated from the fire hydrant, allowing a user to access and maintain the fire hydrant without having to remove valves and rods found in typical fire hydrant barrels in the art.

Figure 2:
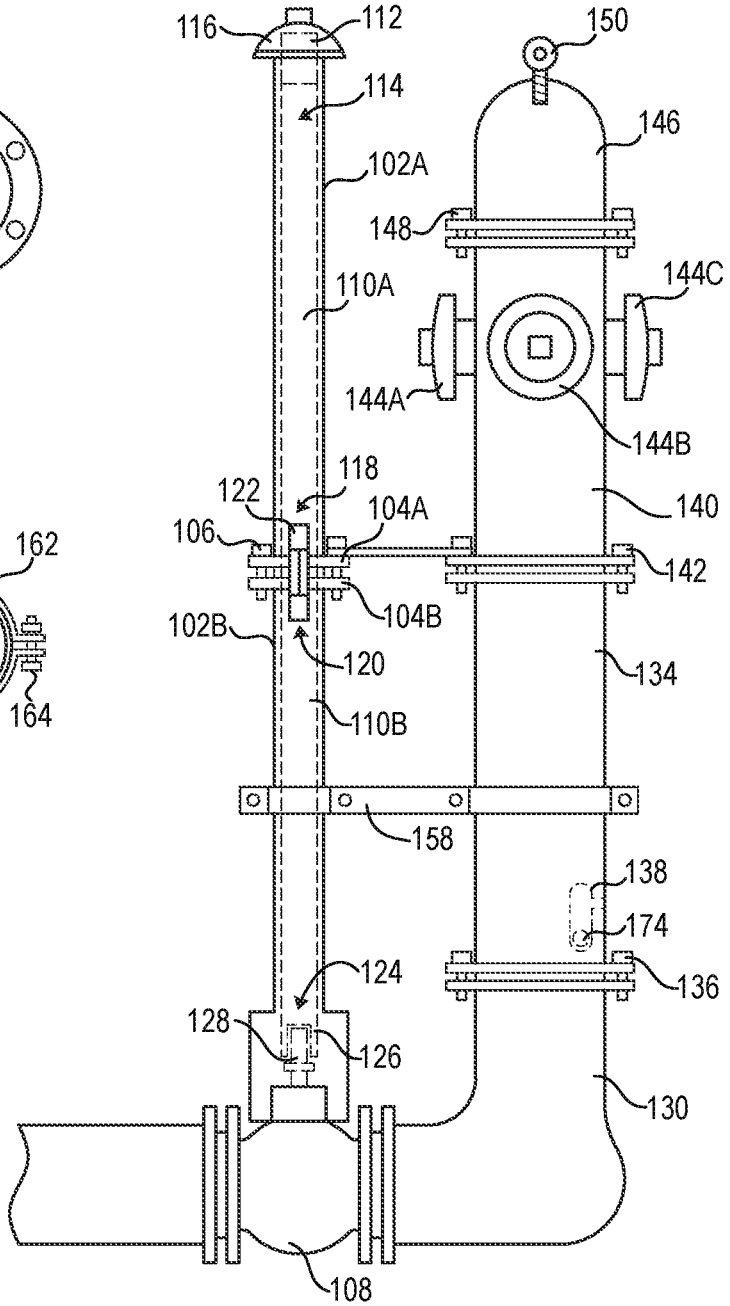
FIG. 2 illustrates a side elevation view of a fire hydrant system.

Referring now to FIGS. 1-2, in one embodiment, a fire hydrant system 100 comprises a first cover tube 102A and a second cover tube 102B. The first cover tube 102A comprises a first flange 104A and the second cover tube 102B comprises a second flange 104B. The first and second flanges 104A, 104B may be coupled together via cover tube bolts 106 (e.g., breakaway bolts) or other coupling mechanisms. The second cover tube 102B may couple to a gate valve 108 while the first cover tube 102A may extend upwardly from ground level. It will be appreciated that the breakaway bolts 106 allow the first cover tube 102A to break away from the second cover tube 102B if, for example, the first cover tube 102A is hit by a vehicle or other object, thereby saving the system 100 from extensive damage.

Positioned inside the first cover tube 102A may be a first valve stem 110A, which may comprise a valve stem nut 112 (e.g., a five-sided nut) on a top end 114 thereof. In some embodiments, a cap cover 116 may be positioned on the first cover tube 102A, covering and protecting the valve stem nut 112. A bottom end 118 of the first cover tube 102A may couple to a top end 120 of a second valve stem 110B via a fastener 122 (e.g., a breakaway stem coupling). While the covers 102A, 102B are discussed as housing two valve stems 110A, 110B, respectively, in some embodiments, one or many valve stems may be used. Additionally, a bottom end 124 of the second valve stem 110B may comprise a stem key adapter 126 that interacts with a valve nut 128 on the gate valve 108. When a user couples a wrench to the valve stem nut 112, which is coupled to the stem key adapter 126, and loosens it, the stem key adapter 126 opens the gate valve 108, allowing water to enter flow through the gate valve 108 and into a shoe fitting 130 and to a fire hydrant 135.

The shoe fitting 130 may comprise a first drain valve 132 (more fully described hereinbelow), such as an auto drain valve (e.g., pressure valve). The shoe 130 fitting may be an L-shaped fitting that couples to a lower barrel 134 of fire hydrant 135 via bolts 136. In some embodiments, the lower barrel 134 may comprise a second drain valve 138 (shown in FIG. 3), such as a side mounted auto drain valve. It will be appreciated that the fire hydrant system 100 comprises either the first drain valve 132 or the second drain valve 138, separately. While discussed as being separate, it could be envisioned that the system 100 may comprise multiple drain valves. Either or both the first drain valve 132 and the second drain valve 138 allow water to drain from the system 100 so as to prevent damage during freezing temperatures. The lower barrel 134 may be positioned underground and extend vertically and couple to a hydrant upper barrel 140 via bolts 142. The hydrant upper barrel 140 is positioned above ground and may comprise one or more water outlets 144A-144C. The hydrant upper barrel 140 may be coupled to a bonnet 146 via bolts 148. The bonnet 146 may comprise an eye bolt 150 that allows a user to lift and maneuver the hydrant upper barrel 140 and bonnet 146 (collectively referred to as the fire hydrant 135).

Figure 3:
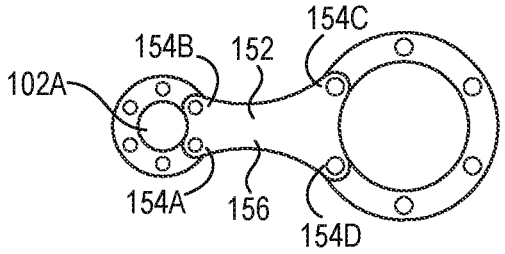
FIG. 3 illustrates a top plan view of a first support of a fire hydrant system.
Figure 4:
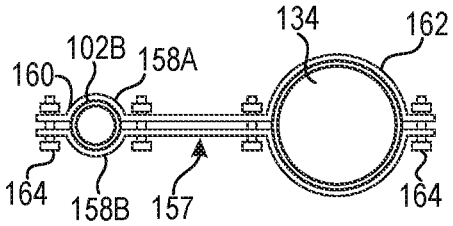
FIG. 4 illustrates a top plan view of a second support of a fire hydrant system.

In some embodiments, as shown in FIG. 3, the fire hydrant system 100 may comprise a first support 152 that extends between the first cover tube 102A and the fire hydrant 135, coupling to the bolts 142 on the fire hydrant 135 and the cover tube bolts 106. In particular, the first support 152 may comprise a first arm 154A, a second arm 154B, a third arm 154C, and a fourth arm 154D with a body 156 extending between the first and second arms 154A, 154B and the third and fourth arms 154C, 154D. In some embodiments, as shown in FIG. 4, a second support 157 may comprise a first arm 158A and a second arm 158B which extend between the second cover tube 102B and the lower barrel 134. More specifically, the second support 158A, 158B may have a first end 160 sized to receive and wrap around the second cover tube 102B and a second end 162 sized to receive and wrap around the lower barrel 134. The second supports 158A, 158 may couple to the second cover tube 102A and the lower barrel 134 via bolts 164, or other coupling mechanisms. It will be appreciated that the first and second supports 152, 157 stabilize and add rigidity to the fire hydrant system 100.

Figure 5:
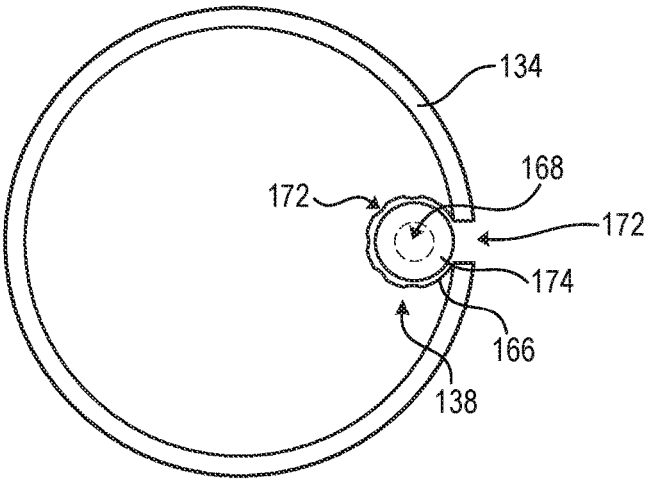
FIG. 5 illustrates a top plan view of a horizontal cross-section of a lower barrel having a second drain valve of a fire hydrant system.
Figure 6:
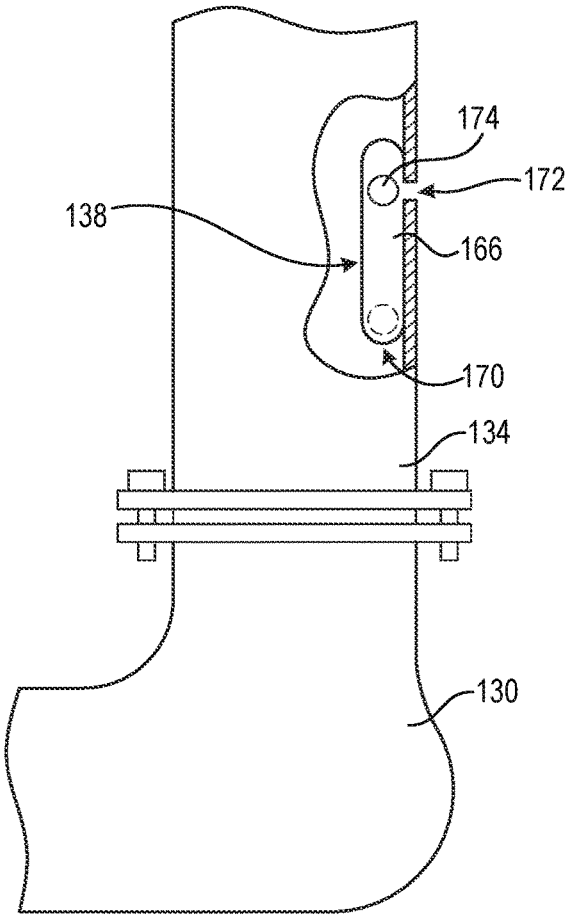
FIG. 6 illustrates a side elevation view of a second drain valve of a fire hydrant system.
Figure 7:
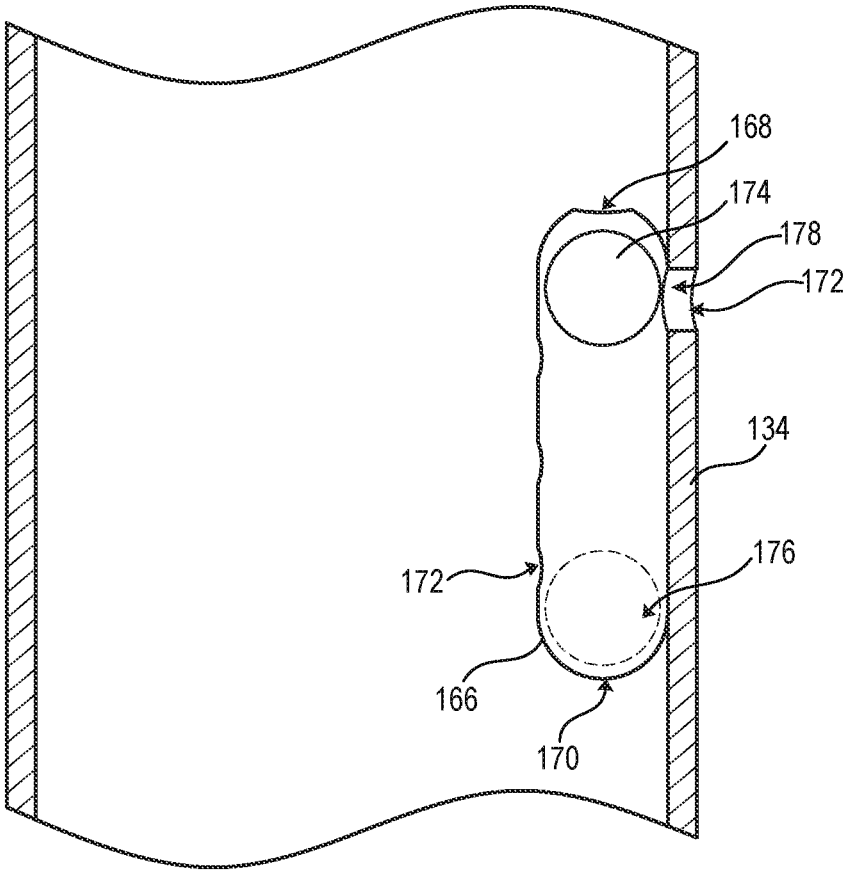
FIG. 7 illustrates a detailed, side elevation view of a longitudinal cross-section of a lower barrel having a second drain valve of a fire hydrant system.

Referring to FIGS. 5-7, in some embodiments, the second drain valve 138 may be positioned on an inner wall of the lower barrel 134. The second drain valve 138 may comprise a housing 166 (e.g., a cylindrical housing) with a top opening 168 and a bottom opening 170. Additionally, other inlet/outlet openings 172 may be along a side of the housing 166. Near the top opening 168, the lower barrel 134 comprises a water opening 172 to release water after the gate valve 108 is sealed. A float ball 174 may be positioned inside of the housing 166. In one embodiment, the float ball 174 may be a counterweight equal to a six foot water column. When a certain amount of water enters the lower barrel 134, the float ball 174 goes from a first, open position 176 (ball resting at the bottom opening) to a second, closed position 178 (ball at the top opening 168 and sealing the water opening 172). Accordingly, when the water ceases flowing through the lower barrel 134, the float ball 174 returns to the first position 176, allowing the water in the upper barrel 140 and the lower barrel 134 to drain via the water opening 172.

Figure 8:
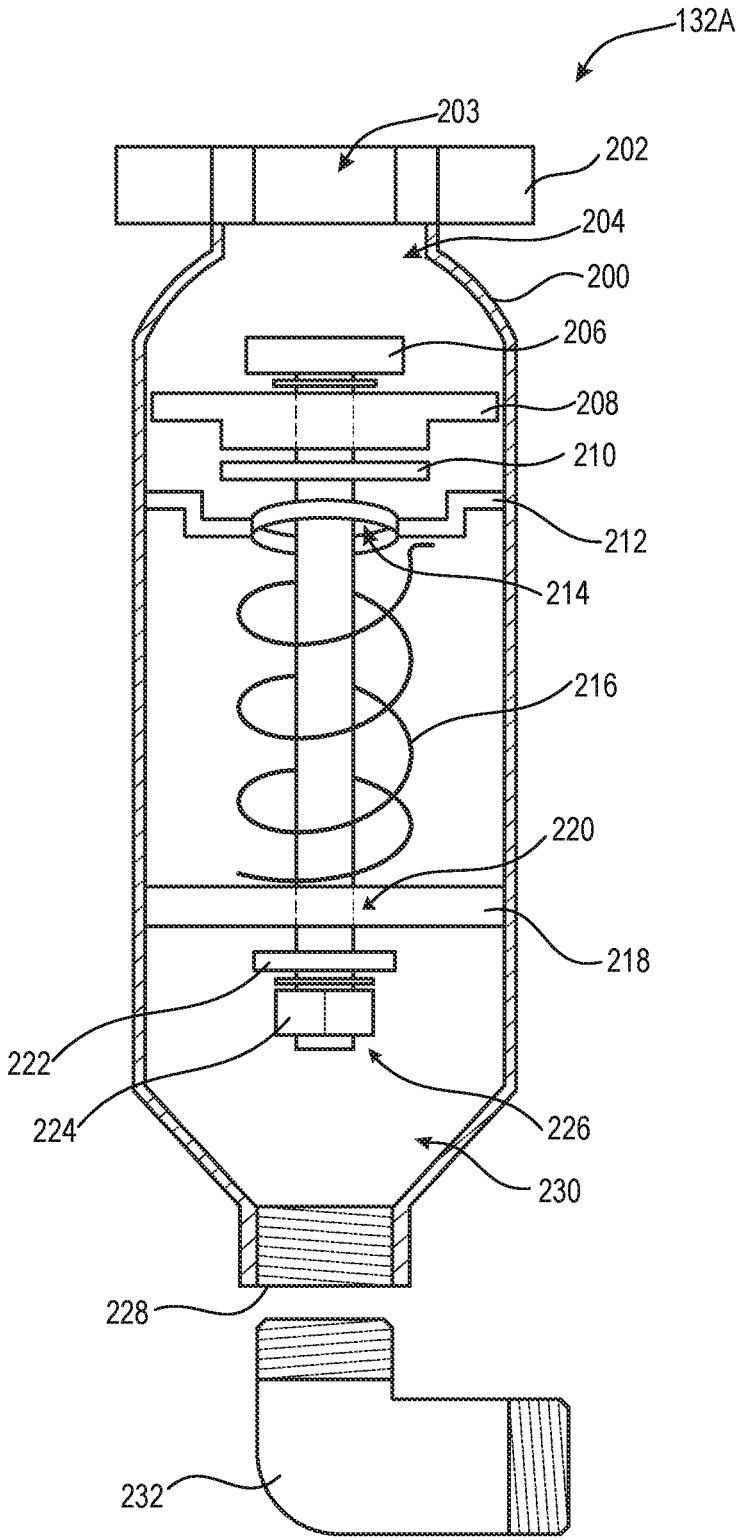
FIG. 8 illustrates a side elevation cross-sectional view of a first drain valve of a fire hydrant system.

In some embodiments, as shown in FIG. 8, the first drain valve 132A on the shoe fitting 130 may comprise a housing 200 with a drain valve ear 202 having a water inlet 203 at a top 204 of the housing 200. In some embodiments, the housing 200 may be two inches in diameter, although size may vary. The housing 200 may comprise an inner housing bolt 206, a stopper 208 connected to the bolt 206, and a rubber seal 210 positioned below the stopper 208. The stopper 208 may rest in an upper housing support 212 and cover an upper housing aperture 214. A spring 216 may be coupled to the inner housing bolt 206 and be interposed between the upper housing support 212 and a lower housing support 218. The inner housing bolt 206 may then extend through a lower housing aperture 220 on the lower housing support 218. A washer 222 and a nut 224 may be positioned on a bottom 226 of the inner housing bolt 206. The housing 200 may further comprise an outlet 228 at a bottom 230 of the housing 200. In some embodiments, the outlet 228 may be threaded to receive pipe extension 232. When a certain amount of water (e.g., equal to six feet of water column inside the fire hydrant) enters the system 100, the spring 216 may compress, thereby allowing the stopper 208 to seal the upper housing aperture 214 and prevent water from leaving the system 100. After the water is shut off, and the pressure on the spring 216 reduced, the spring 216 may extend, unseating the stopper 208 from the upper housing aperture, allowing water to drain through upper housing aperture 214 and down through outlet 228.

Figure 9:
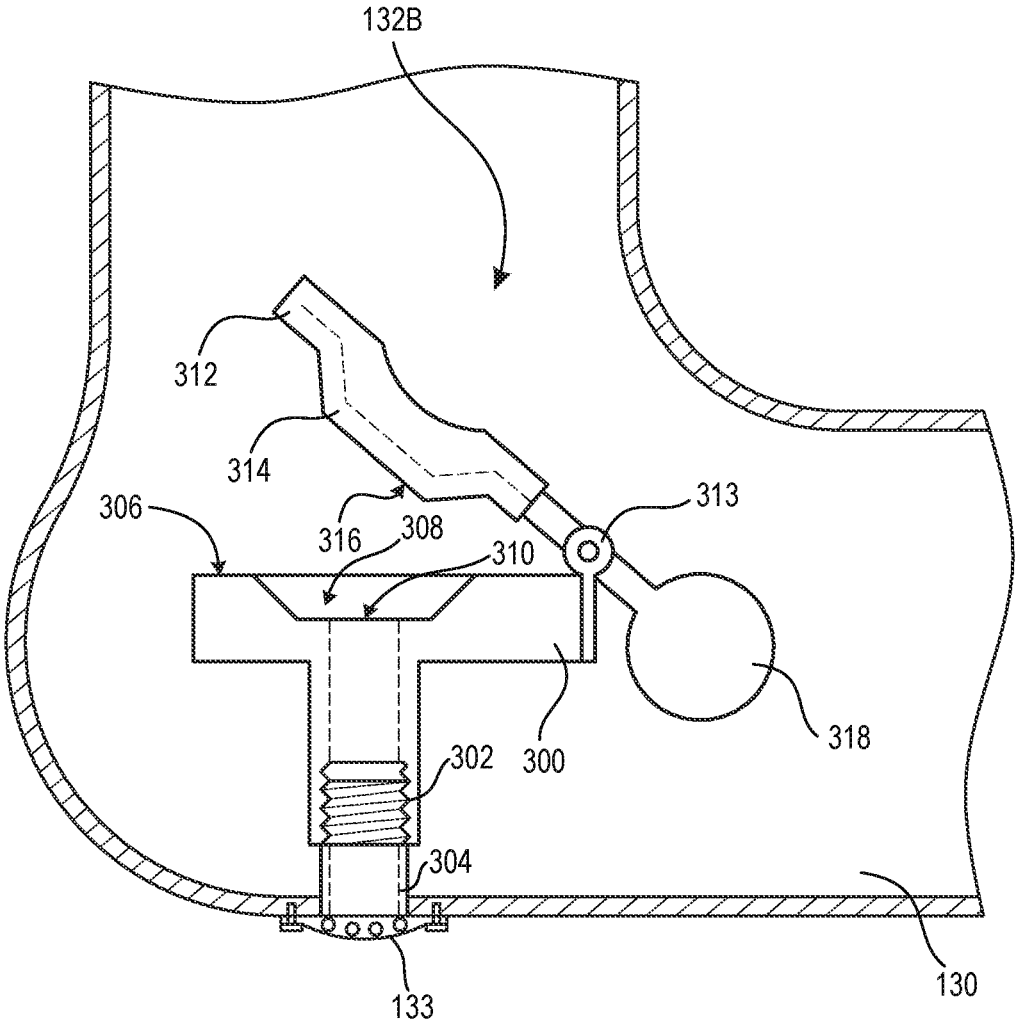
FIG. 9 illustrates a side elevation cross-sectional view of a shoe fitting having a first drain valve in an open position.

Additionally, in some embodiments, as shown in FIG. 9, a first drain valve 132B may comprise a platform 300 with an outlet 302 extending from the bottom thereof. In some embodiments, the platform 300 may be stainless steel. The outlet 302 may be threaded to receive a drainpipe 304 in the shoe fitting 130. A top 306 of the platform 300 may comprise a recessed area 308 with an opening 310 therein. A cover/flapper 312 (e.g., a steel cover with rubber thereon) may be hingedly coupled to the platform 300 via hinge 313. The cover 312 may comprise a protrusion 314 on a lower surface 316 that mates with the recessed area 308 on the platform 300. The cover 312 may be coupled to a weight 318, (e.g., weighted ball). In one embodiment, the weight 318 may be a counterweight equal to a six foot water column inside the lower barrel 134. Accordingly, when water enters the system 100 at a certain rate, the weight 318 is overcome, and the cover 312 seals the opening 310 in the recessed area 308. When water flow ceases and less than six feet of water remains, the weight 318 pivots the cover 312 to an open position (shown in FIG. 9), allowing water to enter into the opening 310 and drain through drainpipe 304. In some embodiments, a drain hole cover cap 133 (e.g., a metal cap) with apertures may cover the drainpipe 304 to protect debris from entering therein. Additionally, while a drain hole cover cap 133 is illustrated, it will be appreciated that some embodiments do not comprise a drain hole cover 133.

Figure 10:
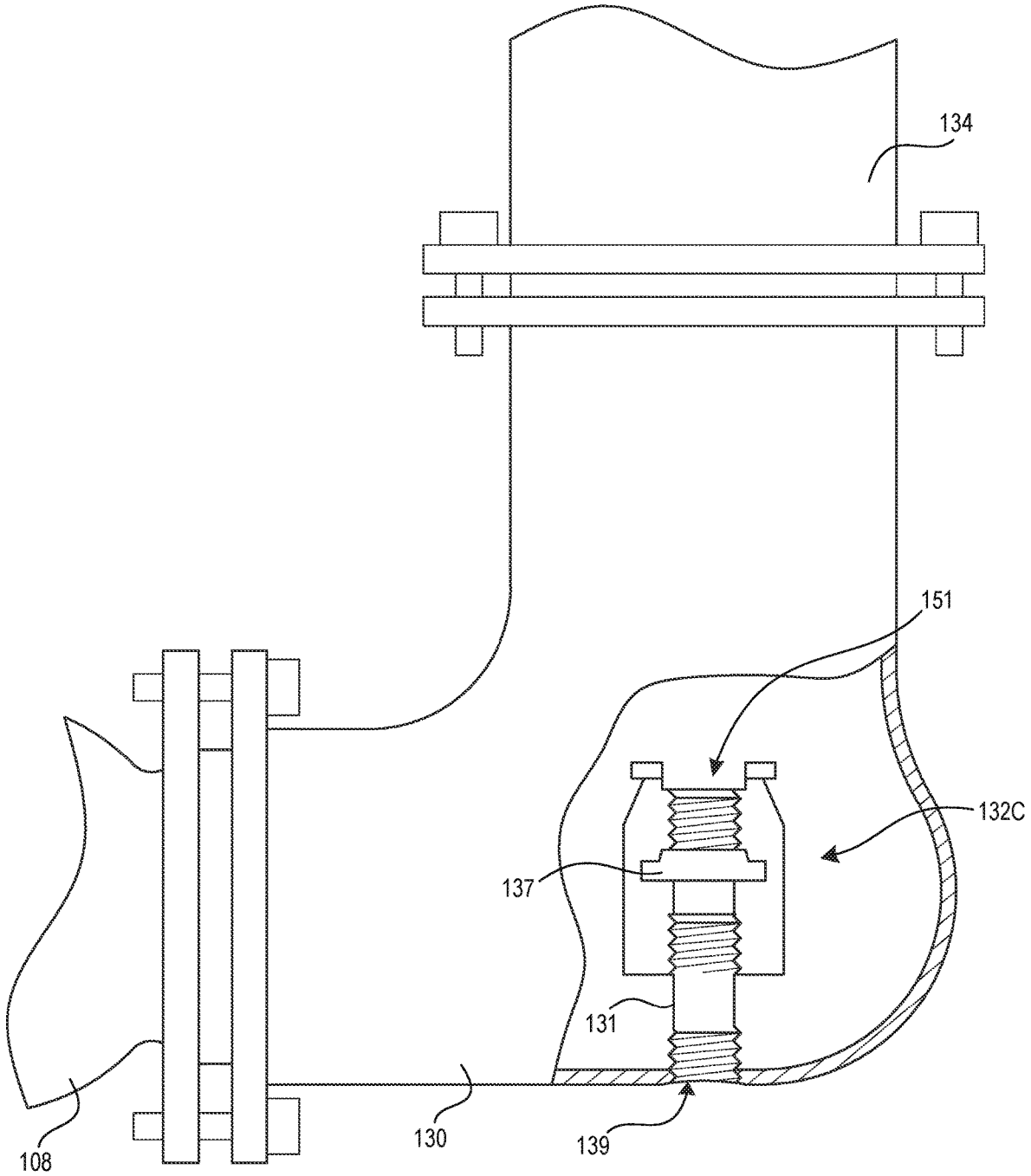
FIG. 10 illustrates a side elevation view of a shoe fitting with a cutout showing a first drain valve of a fire hydrant system.
Figure 11:
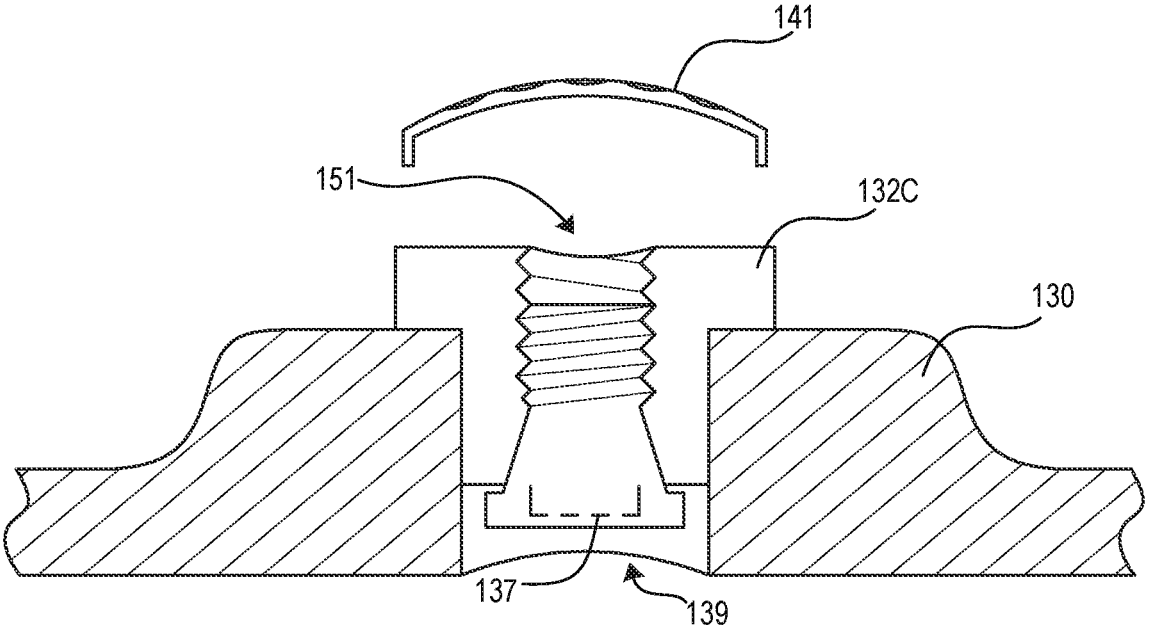
FIG. 11 illustrates a side elevation cross-sectional view of a first drain valve coupled to a drain outlet of a fire hydrant system.
Figure 12:
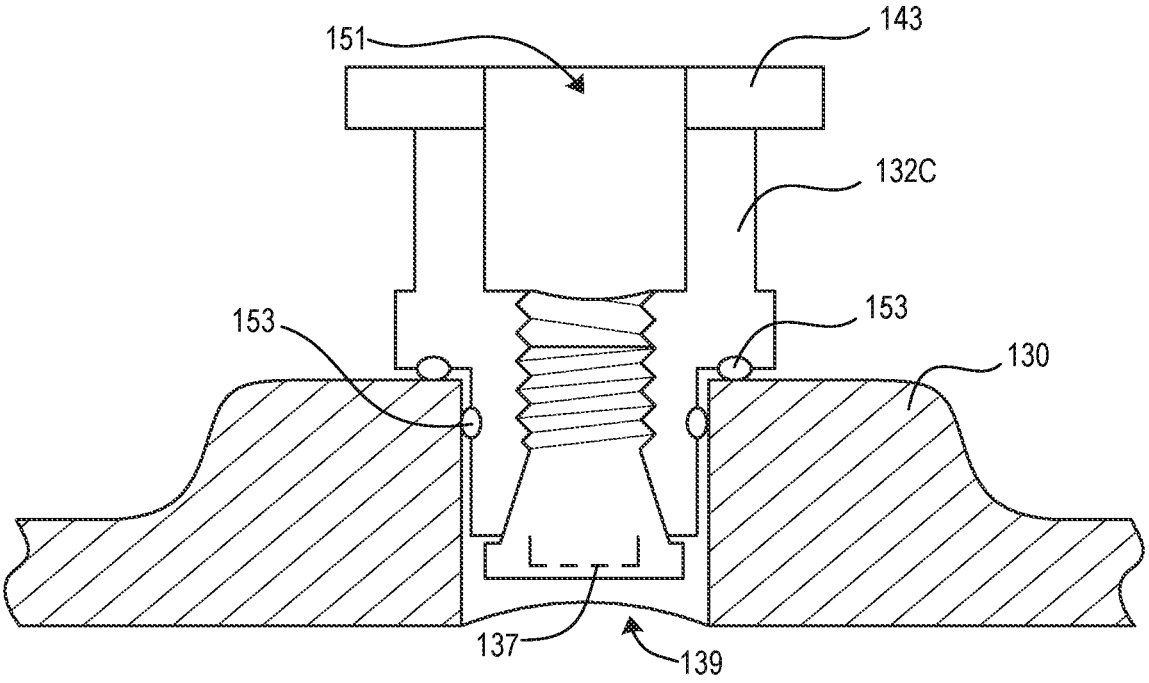
FIG. 12 illustrates a side elevation cross-sectional view of a first drain valve coupled to a drain outlet of a fire hydrant system.
Figure 13:
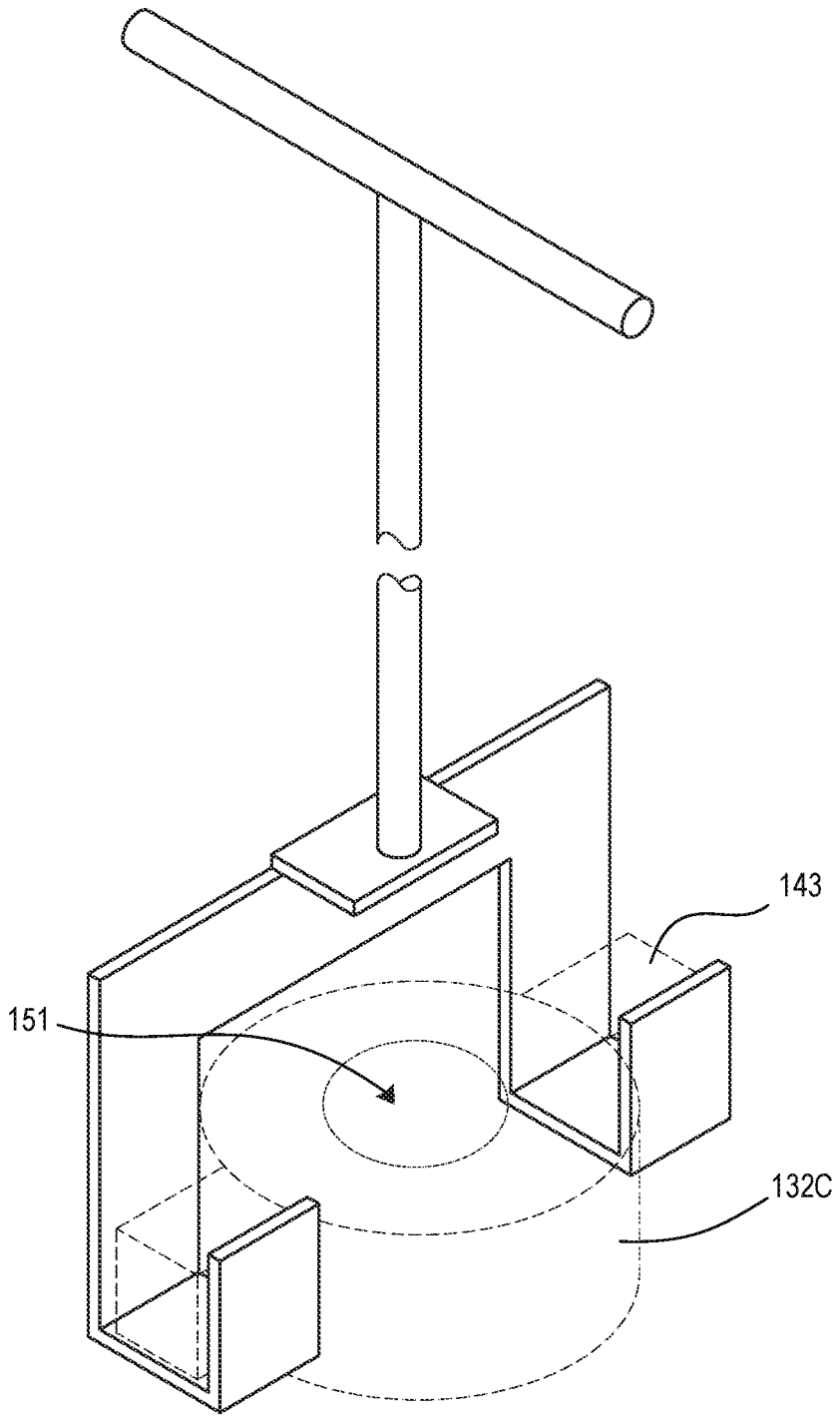
FIG. 13 illustrates a top perspective view of an arm tool of a fire hydrant system.

Referring to FIG. 10, in some embodiments, the first drain valve 132C may be a pressure drain valve (e.g., an auto active disc diaphragm). The pressure drain valve 132C may couple to the shoe fitting 130 via a threaded nipple 131 or any other securement mechanism. In one embodiment, the pressure drain valve 132C comprises a disc diaphragm 137. The diaphragm 137 actuates to either seal access to the drain outlet 139 or to open it. For example, water enters the first drain valve 132C via an inlet 151. When the gate valve 108 is open and water enters the shoe 130, the pressure on the disc diaphragm 137 causes it to close. When the gate valve 108 is closed, pressure is relieved on the disc diaphragm 137, allowing it to open and allow water to flow through the nipple 131 and out the outlet 139. In some embodiments, as shown in FIG. 11, a steel drain valve cover 141 may be positioned on top of the pressure drain valve 132C to prevent debris from entering the opening 151. As illustrated in FIG. 11, a nipple 131 is not needed and the pressure drain valve 132C may be seated in the outlet 139 of the shoe 130. In some embodiments, as shown in FIG. 12, the pressure drain valve 132C may comprise ears 143 to aid in installing and removing the pressure drain valve 132C. Likewise, it may be seated directly in outlet 139 and may comprise O-rings 153 or other seals to prevent leakage. As other embodiments, water enters through inlet 151, which actuates the disc diaphragm 137 in a first, closed direction or a second, open direction. When in an open direction (gate valve 108 closed), pressure is low and any remaining water drains out of outlet 139. As shown in FIG. 13, to remove, replace, or install a drain valve 132C, it will be appreciated that a user may use an arm tool 400. The arm tool 400 encompasses the ears 143, thereby allowing a user to twist the arm tool 400 and thereby the drain valve 132C, such as to extract the drain valve 132C from the shoe 130.

Figure 14:
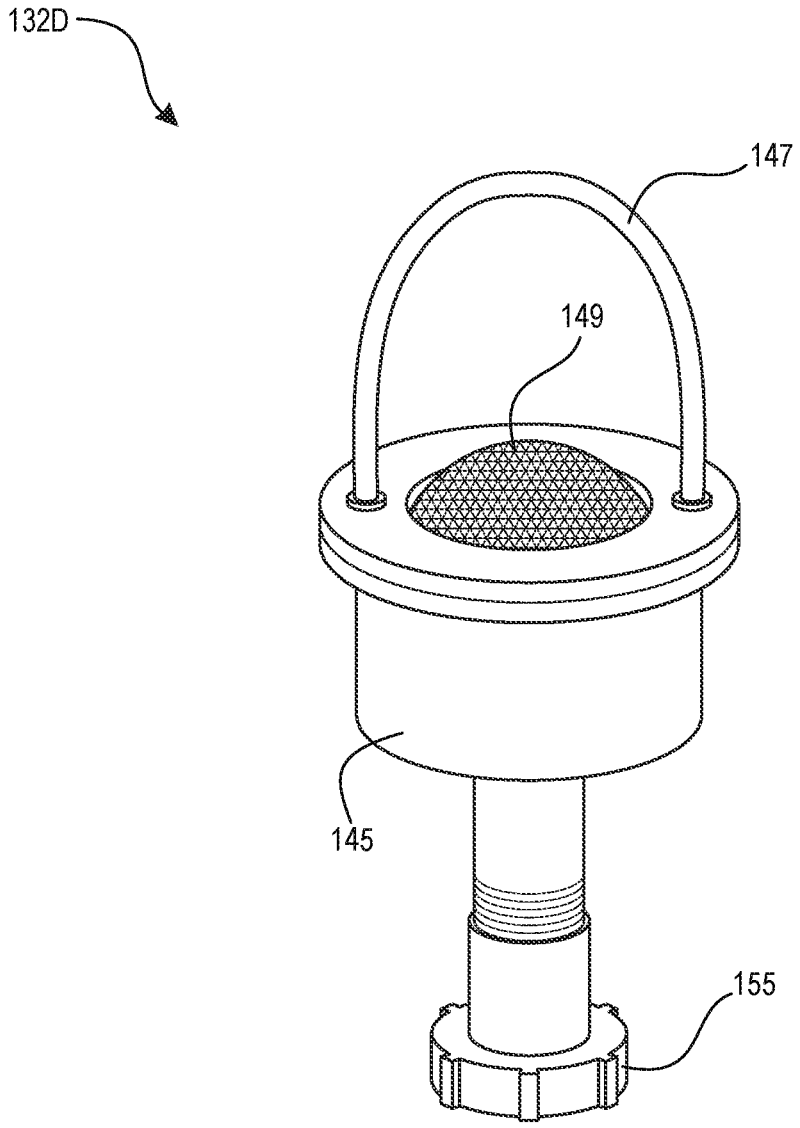
FIG. 14 illustrates a side perspective view of a first drain valve of a fire hydrant system.

As shown in FIG. 14, in one embodiment, the first drain valve 132D may comprise a housing 145 and a hook (e.g., a rigid hook) 147 for extracting the drain valve 132D for maintenance. Further, the first drain valve 132D may comprise a screen cover 149 to prevent debris from entering and blocking the inlet to the drain 132D. As a distal end is a standard pressure valve 155 (e.g., irrigation pressure valve) to control the flow of water through the drain valve 132D. In some embodiments, the housing 145 seals the opening in the shoe fitting 130 with the pressure valve extending from the bottom thereof. As other embodiments, when the gate valve 108 is open, the pressure actuates the pressure valve 155, thereby closing the pressure valve 155 and preventing water from exiting. When the gate valve 108 is closed, the pressure is relieved on the pressure valve 155, allowing it to open so that water may exit, thereby draining the fire hydrant 135 of water. It will be appreciated that any of the previously mentioned valves and their components may be combined. For example, the rigid hook 147 as shown coupled to the first drain valve 132D may be coupled to the first drain valve 132B or any other drain valve.

While the system 100 is shown with its various components, it will be appreciated that any fire hydrants on the market, such as Muellar, AVK, Waterous, Clow, MH, and Pacific States, may be retrofitted with the components of the system 100. The five-sided nut found on these hydrants in the prior art may be removed and the hole may be plugged using any plugging procedures known in the art. Additionally, the hydrant stem found in pre-existing fire hydrants is used to operate the main valve. This main stem is used to remove and install a seat ring, which may be removed so that an o-ring may be installed at the first drain valve 132. The seat ring (i.e., valve seat) may then be reinstalled using the main stem valve.

Figure 15A:
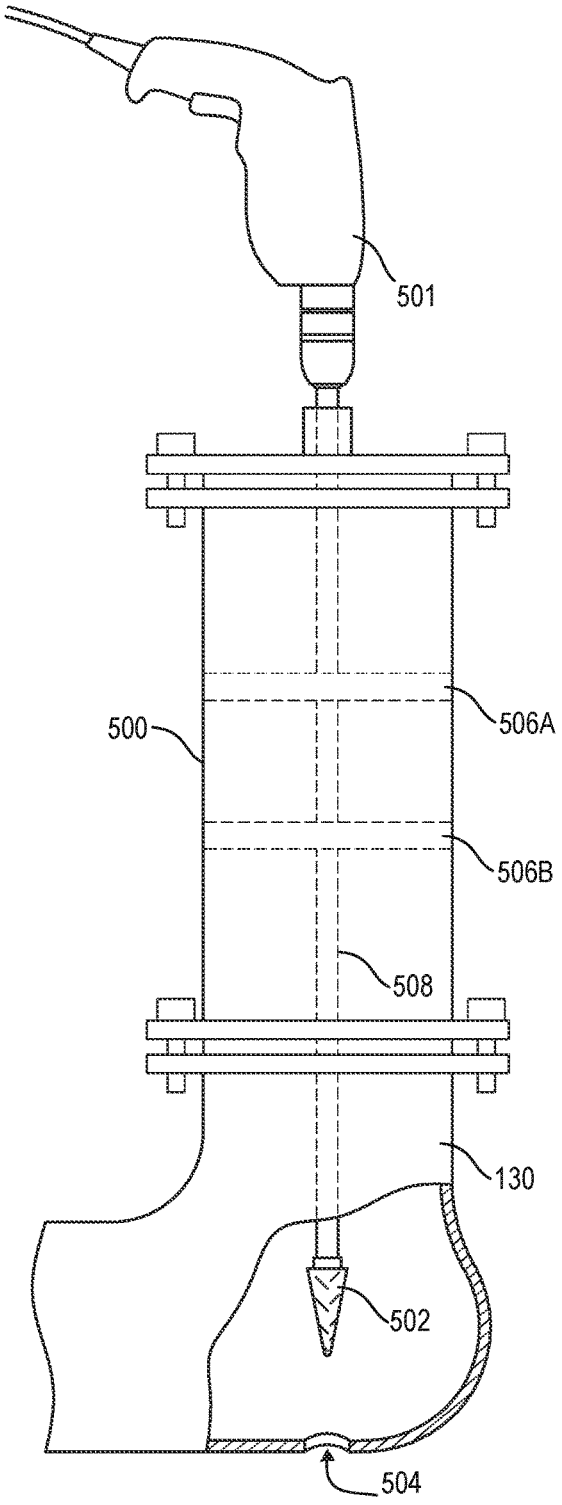
FIG. 15A illustrates a method of retrofitting a fire hydrant of the prior art to be a fire hydrant system using a drill.
Figure 15B:
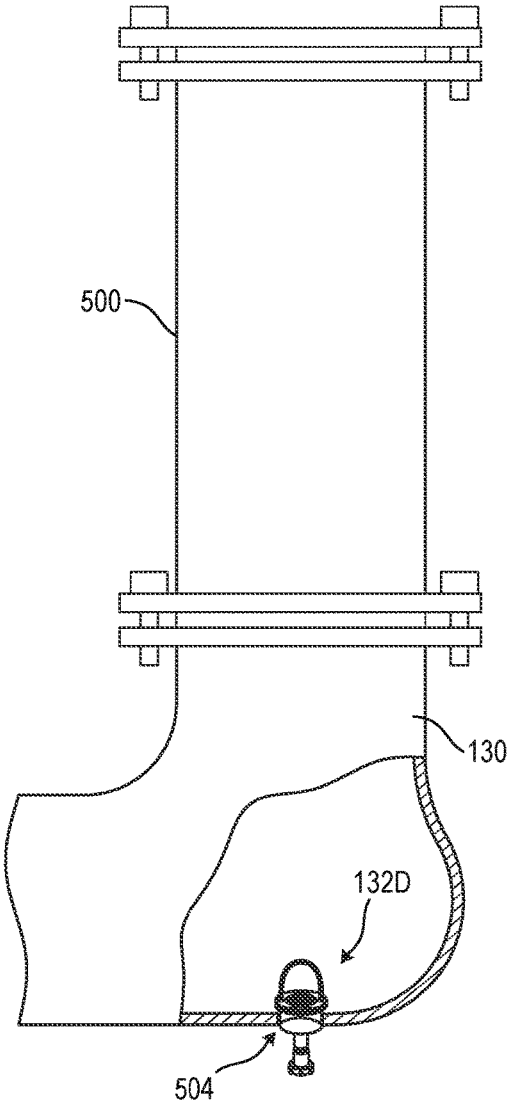
Figure 16:
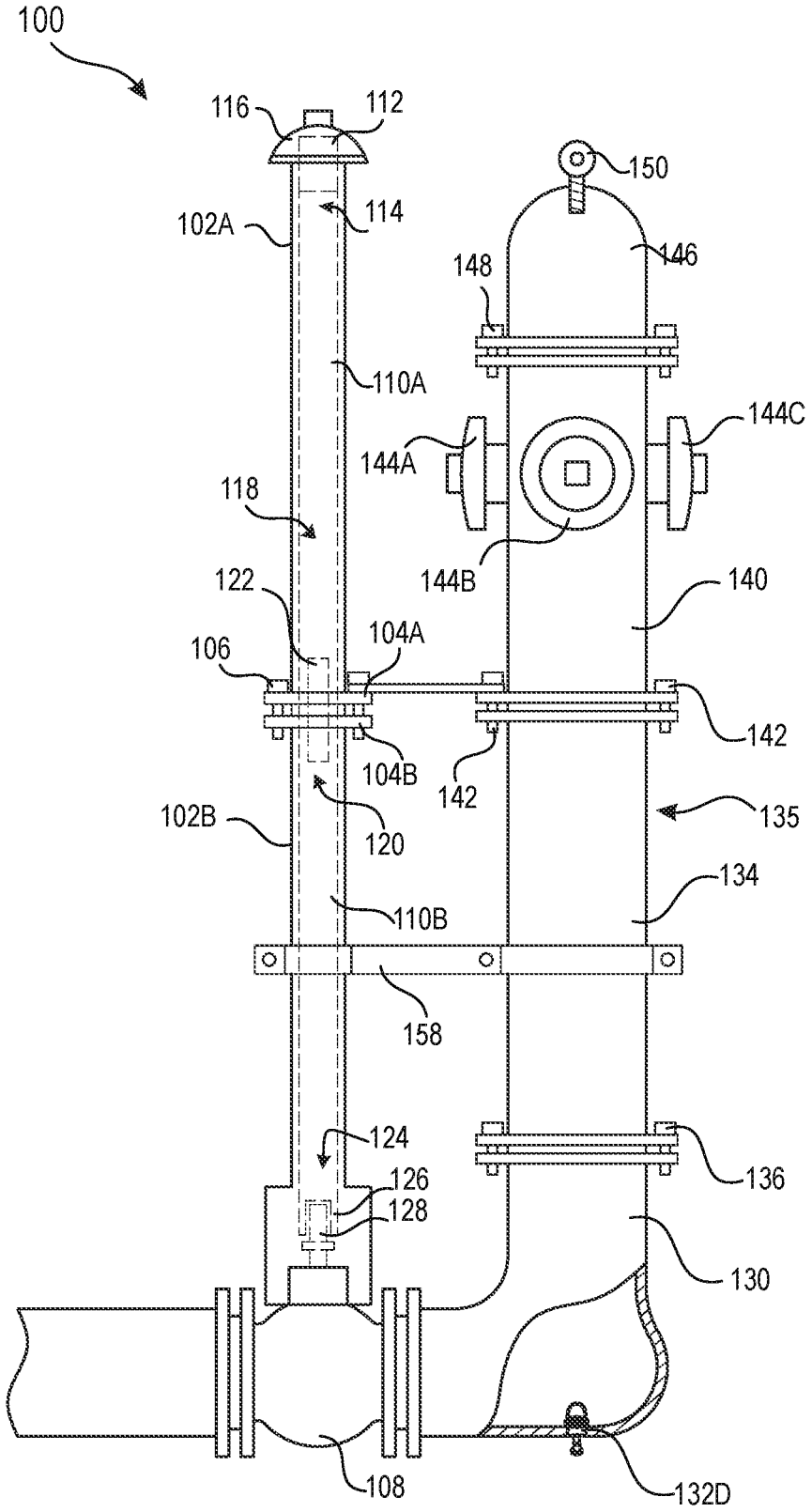
FIG. 16 illustrates a retrofitted fire hydrant of the prior art to be a fire hydrant system.

As illustrated in FIGS. 15A-B, a user may install the first drain valve 132 in pre-existing fire hydrants 500. A user would remove the internal components of the hydrant 500 and then use a drill 501 and a drill bit 502 to puncture a hole 504 in the shoe fitting 130. In some embodiments, support discs 506A, 506B may be used to support a drill rod 508. A drain valve 132 (including 132A-D) may then be inserted into the drilled hole 504, as shown in FIG. 15B. A first cover tube 102A may then be coupled to the second cover tube 102B (the second cover tube may be an existing valve box cover) using breakaway bolts as described earlier herein. A valve stem nut 112 (e.g., hydrant 5-side nut) with its rod may then be inserted through the cover tubes 102A, 102B so as to actuate the valve nut 128 on the gate valve 108. For example, FIG. 16 illustrates a retrofitted fire hydrant system including a drain valve 132D.

Accordingly, the fire hydrant system disclosed herein solves the need for a fire hydrant that is resistant to any type of weather and easy to maintain. In other words, the pressure drain valve allows water to drain from the fire hydrant, preventing freezing. Additionally, a user may easily maintain the pressure valve due to the omission of components in the fire hydrant (as compared to hydrants of the art). A valve stem external to the fire hydrant allows for easy control of the gate valve.

It will also be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A fire hydrant system, comprising:

a first cover tube coupled to a second cover tube;

a valve stem extending through the first and second cover tubes, the valve stem comprising a valve stem nut on a first end and a stem key adapter on a second end, the stem key adapter configured to engage a valve nut of a gate valve;

a hydrant upper barrel coupled to a lower barrel, the lower barrel coupled to a shoe fitting;

a drain valve configured to allow drainage of water from the upper and lower barrels when not in use; and a first support coupling the upper barrel to the first cover tube.

2. The fire hydrant system of claim 1, wherein the drain valve is located in a shoe fitting.

3. The fire hydrant system of claim 1, wherein the drain valve is located on a side of the lower barrel.

4. The fire hydrant system of claim 1, wherein the drain valve comprises a float ball.

5. The fire hydrant system of claim 1, wherein the drain valve comprises a spring.

6. The fire hydrant system of claim 1, wherein the drain valve comprises a flapper coupled to a weight.

7. The fire hydrant system of claim 1, wherein the drain valve comprises a disc diaphragm.

8. A fire hydrant system, comprising:

a first cover tube coupled to a second cover tube;

a valve stem extending through the first and second cover tubes, the valve stem comprising a valve stem nut on a first end and a stem key adapter on a second end, the stem key adapter configured to engage a valve nut of a gate valve;

a hydrant upper barrel coupled to a lower barrel, the lower barrel coupled to a shoe fitting;

a drain valve in a shoe, the drain valve configured to allow drainage of water from the upper and lower barrels when not in use;

wherein the first cover tube and hydrant upper barrel are above ground and substantially parallel to one another.

9. The fire hydrant system of claim 8, wherein the drain valve comprises a float ball.

10. The fire hydrant system of claim 8, wherein the drain valve comprises a spring.

11. The fire hydrant system of claim 8, wherein the drain valve comprises a flapper coupled to a weight.

12. The fire hydrant system of claim 8, wherein the drain valve comprises a disc diaphragm.

13. The fire hydrant system of claim 8, further comprising a first support coupling the upper barrel to the first cover tube.

14. A method of retrofitting a fire hydrant into a fire hydrant system, the method comprising:

removing the operating nut and stem from the fire hydrant;

drilling a hole in the bottom of the shoe;

installing a drain valve in the drilled hole;

coupling a first cover tube to a riser box of a gate valve;

inserting a valve stem through the first cover tube with a valve nut exposed, the valve stem comprising a valve stem key adapter for engaging a valve nut on the gate valve.

* * * * *